US008523716B2

(12) United States Patent
Simon

(10) Patent No.: US 8,523,716 B2
(45) Date of Patent: Sep. 3, 2013

(54) FREE-STANDING POST

(75) Inventor: Yoann Simon, Lille (FR)

(73) Assignee: Decathlon, Villeneuve d'Ascq (FR)

( * ) Notice: Subject to any disclaimer, the term of this patent is extended or adjusted under 35 U.S.C. 154(b) by 248 days.

(21) Appl. No.: 13/048,081

(22) Filed: Mar. 15, 2011

(65) Prior Publication Data

US 2011/0230284 A1 Sep. 22, 2011

(30) Foreign Application Priority Data

Mar. 16, 2010 (FR) ..... 10 51862

(51) Int. Cl.
*A63B 61/00* (2006.01)

(52) U.S. Cl.
USPC ..... 473/492; 473/494

(58) Field of Classification Search
USPC ..... 473/490, 492, 494; 248/188.1, 188.5, 248/188.7
See application file for complete search history.

(56) References Cited

U.S. PATENT DOCUMENTS

| | | | | |
|---|---|---|---|---|
| 3,195,898 | A * | 7/1965 | Respini | 473/197 |
| 4,274,632 | A * | 6/1981 | Jacobs | 473/492 |
| 5,176,344 | A * | 1/1993 | Eberhard | 248/156 |
| 5,569,094 | A | 10/1996 | Macaluso | |
| 5,816,956 | A * | 10/1998 | Ellis et al. | 473/490 |
| 6,461,258 | B1 * | 10/2002 | Vacanti | 473/494 |
| 7,037,221 | B2 * | 5/2006 | Bouffard et al. | 473/492 |
| 7,223,187 | B1 * | 5/2007 | Bouffard et al. | 473/492 |
| 7,455,603 | B2 * | 11/2008 | Bouffard et al. | 473/492 |
| 2007/0087869 | A1 * | 4/2007 | Lin | 473/490 |
| 2011/0230284 | A1 * | 9/2011 | Simon | 473/485 |

FOREIGN PATENT DOCUMENTS

FR 1 341 549 A 11/1963

OTHER PUBLICATIONS

European Search Report: FA735938 FR1051862 dated Nov. 29, 2010.

* cited by examiner

*Primary Examiner* — Raleigh W Chiu
(74) *Attorney, Agent, or Firm* — Ladas & Parry LLP

(57) ABSTRACT

The invention relates to a free-standing post comprising stabilizer means for stabilizing it on the ground, a non-rigid element for holding an article, which element extends upwards over a height H and has a bottom portion extended by a top portion. First anchor means are arranged between the stabilizer means and the bottom portion. In addition, a flexible longitudinal element is of length greater than the height H of the non-rigid element. Second anchor means are arranged between the bottom end of the flexible longitudinal element and the stabilizer means. Third anchor means are arranged between the top end of the flexible longitudinal element and the top end of the top portion of said non-rigid element. The invention also relates to a sport game set equipped with at least one such free-standing post.

27 Claims, 7 Drawing Sheets

FREE-STANDING POST

FIELD OF THE INVENTION

The present invention relates in particular to a free-standing post for supporting an article. Such an article may, for example, be a tennis or volleyball net, in which case two free-standing posts are necessary for supporting respective ones of the ends of said net, the two posts being disposed at some distance apart so as to keep the net tensioned. However, such an article may also be constituted by a panel, e.g. constituting a basketball basket or a dartboard. The invention thus also relates to sport game sets equipped with free-standing posts of the present invention.

BACKGROUND OF THE INVENTION

Free-standing posts are known, in particular from U.S. Pat. No. 6,461,258. That document discloses a sport game set of the volleyball type comprising two free-standing posts and a net. Each free-standing post comprises a base and a pole extending vertically and having its bottom end fastened to the base. At each of its side ends, the net has two cables disposed respectively at the bottom portion and at the top portion of said net. The bottom and top cables pass through the vertical pole. In addition, each free-standing post further comprises at least one bow-shaped flexible blade having its bottom fastened to the bottom end of the pole, on the outside thereof, said bow-shaped flexible blade extending upwards and outwards. In addition, the ends of the bottom and top cables are fastened to that bow-shaped flexible blade. That design makes it possible to tension the net and to keep it at a certain height. In addition, implementing a base makes the post a free-standing post, and offers the advantage of making it possible to set up the sport game set on different types of surfaces such as grass or sand.

OBJECT AND SUMMARY OF THE INVENTION

An object of the present invention is to provide a free-standing post of design also enabling it to be set up on various types of surface. Objects of the design of the free-standing post of the present invention are also to limit its weight, to limit its manufacturing cost, to facilitate setting it up, to make it compact to stow, and safe in appearance, and thereby to enable the sport game set including one or more free-standing posts to achieve the same objects.

To this end, the free-standing post of the present invention comprises stabilizer means for stabilizing it on the ground, in particular a stabilizer base arranged to stand on a surface such as, for example, tarmac, sand, grass, or some other surface. However, it is possible to make provision for the stabilizer means to be implemented from a plurality of stabilizer bases or the like, in particular of small size, and jointly stabilizing the free-standing post in a more or less vertical position. Such a stabilizer base, or each of such stabilizer bases, is designed, in particular, as described in more detail below through non-limiting examples, to arrange the free-standing post of the invention on any type of surface. However, it is possible to make provision for such stabilizer means to be implemented by means of pegs or stakes co-operating with the other elements of the free-standing post, when the surface on which said free-standing post is installed is of the grass type or of a similar type, into which the pegs or stakes can be driven.

In addition, the free-standing post further comprises a non-rigid element that extends upwards over a height H and has a bottom portion, in particular in the form of guys, which bottom portion is extended by a top portion, in particular by a longitudinal top portion. This non-rigid element, in particular its top portion, is arranged to hold an article, such as, for example, one of the ends of a net, or indeed a panel consisting, for example, of a basketball basket or of a dartboard. First anchor means are arranged between the stabilizer means and the bottom portion of the non-rigid element.

In addition, the free-standing post of the invention further comprises a flexible longitudinal element of length greater than the height H of the non-rigid element, second anchor means being arranged between the bottom end of the flexible longitudinal element and the stabilizer means. Similarly, third anchor means are arranged between the top end of said flexible longitudinal element and the top end of the top portion of the non-rigid element.

Thus, when the first, second, and third anchor means are put in place between the stabilizer means, the non-rigid element and the flexible longitudinal element, the difference in length between said flexible longitudinal element and the non-rigid element makes it possible to bow said flexible longitudinal element, while the non-rigid element is held tensioned more or less vertically between the stabilizer base and the top end of the flexible longitudinal element, in the manner of a bow string. In addition, the stabilizer means make it possible to stabilize both said non-rigid element and the flexible longitudinal element. Holding said non-rigid element tensioned substantially vertically between the base and the flexible longitudinal element also makes it possible to fasten an article, in particular to the longitudinal top portion of said non-rigid element. However, it is also possible to make provision to fasten an article to the bottom portion of said non-rigid element, depending on the design thereof.

Preferably, the non-rigid element of the free-standing post of the present invention is made of a textile material. However, it is possible to consider using other materials such as an elastomer that has little or no extensibility. It can also be understood that the use of such a non-rigid element makes it possible to limit the presence of rigid and generally metal structural elements that are of greater weight than textile materials or indeed than elastomers. This also facilitates stowage.

According to the invention, the stabilizer means, consisting in particular of a stabilizer base, are provided with at least two first fastener systems, the bottom portion of the non-rigid element being constituted by at least two guys, in particular of the strap type, that extend downwards while forming an angle between them, the bottom ends of the guys being provided with second fastener systems co-operating with respective ones of the first fastener systems on the base.

In an embodiment, the stabilizer means consist of a stabilizer base provided with three first fastener systems that are distributed triangularly, the bottom portion of the non-rigid element being made up of three guys, in particular of the strap type, disposed in a tripod configuration. In addition, one of the three guys is disposed extending the longitudinal top portion. This offers the advantage of enabling this guy of the bottom portion to be used for fastening to an article, e.g. to the end of a net used for playing tennis or for playing football-tennis.

According to the invention, the stabilizer means consist of a stabilizer base comprising three stabilizer legs disposed in a star-shaped configuration. Other variants are possible, in particular a stabilizer base comprising a hub and at least two stabilizer legs.

According to the invention, the stabilizer means consist of a stabilizer base further comprising a system for improving its compactness in a stowage mode. It is thus possible to improve the compactness of the free-standing post and therefore of the sport game set made up of one or more free-standing posts.

In the embodiment in which the base comprises three stabilizer legs disposed in a star-shaped configuration, i.e. their proximal first ends are assembled together, the stabilizer legs extending in the same plane while forming angles between them, said proximal first ends are assembled together in pivotally mounted manner so as to enable them to be folded away against one another in said plane, thereby improving compactness.

In the embodiment in which the stabilizer base comprises a hub and at least two stabilizer legs, provision is made for the stabilizer legs to engage into the hub, thereby making it possible to remove the stabilizer legs from the hub so as to group them together for compact stowage.

According to the invention, the flexible longitudinal element is preferably constituted by a flexible tube. In addition, this flexible longitudinal element has a system for reducing its length, also making it possible to improve its compactness when the free-standing post is in stowage mode. Such a length reduction system is, for example, constituted by a flexible tube comprising at least two segments or pole pieces that are suitable for being mutually engaged and for being folded up together. However, it is also possible to consider using a flexible tube that is telescopic.

According to the invention, the stabilizer means consist of a stabilizer base provided with an orifice for receiving the bottom end of the flexible longitudinal element, in particular in the form of a flexible tube. Preferably, this orifice is configured to incline the bottom end of the flexible longitudinal element engaged in said orifice. This offers the advantage of guiding the flexible longitudinal element during assembly of the free-standing post and of contributing to the stability of the flexible longitudinal element in its bowed position, keeping the non-rigid element tensioned vertically. However, it is possible to provide other systems for fastening and guiding the flexible longitudinal element relative to the stabilizer base without going beyond the ambit of the invention. When the flexible element is fastened to and guided on the stabilizer base, it is also conceivable to implement a non-rigid element having its bottom portion and its top portion constituted by a single common strap or the like, the top end of the strap being fastened to the top end of the flexible element and the bottom end of the strap being, for example, fastened to the base, which is anchored in the ground by means of a peg or stake, or is fastened to an additional weight lying on the ground.

In an embodiment of the invention, the top portion of the non-rigid element is constituted by a strap. However, variants are possible, such as, for example, a rope or the like. The same applies for the bottom portion of the non-rigid element. It is also possible to make provision for combinations of straps and of ropes or the like between the bottom portion and the top portion of the non-rigid element.

According to the invention, a fastener system is arranged on the non-rigid element for securing to an article, in particular a panel or one end of a net. Preferably, this fastener system is implemented on the longitudinal top portion of the non-rigid element. However, it is possible to make provision to implement it on the bottom portion of the non-rigid element or indeed on both portions at the same time.

According to the invention, height adjustment means are arranged between the fastener system on the article and the non-rigid element. One purpose of this is to make it possible to adjust the position of the article fastened to the free-standing post, e.g. as a function of the height of the users, who might be children or adults. Another purpose of this is to make it possible to use the same post for fastening to various different types of article, depending on the sport being played.

According to the invention, a system for indicating the height position of the fastener system is arranged on the non-rigid element. This offers the advantage of enabling the article, in particular of the panel or net type, to be positioned appropriately depending on the sport being played.

According to the invention, the stabilizer means further comprise weighing-down means. This offers the advantage of reinforcing the stability of the free-standing post, in particular when the article is of the panel type or indeed of compensating for any forces that might be exerted on the net fastened to the post when, for example, the player leans unintentionally on the net while playing the sport. When the stabilizer means are made up of a stabilizer base comprising a hub and stabilizer legs, it is possible to make provision for the hub to constitute said weighing-down means. It is also possible to make provision for the weighing-down means to be disposed in remote-from-center manner on at least one of the stabilizer legs, in addition to or instead of the hub constituting said weighing-down means. When the stabilizer means consist of a stabilizer base comprising three stabilizer legs disposed in a star configuration and preferably hinged together, the weighing-down means are preferably also disposed in remote-from-center manner on said stabilizer legs. By disposing the weighing-down means in remote-from-center manner, it is advantageously possible to compensate more easily for the torque exerted on the stabilizer base by the article suspended from the non-rigid element and thus, to reduce the size and the weight of the weighing-down means. It is thus also possible to improve the compactness of the free-standing post in the stowed position, and, in addition, to facilitate transporting it in said stowed position.

In addition, in accordance with the invention, such weighing-down means may either be incorporated into the stabilizer means or be removable relative thereto. For example, it is possible to provide small-size weights that are positioned on the distal ends of the stabilizer legs of the stabilizer base.

In addition, the invention provides a sport game set comprising one or more free-standing posts of the invention.

In a first embodiment, this sport game set comprises two free-standing posts and a net provided at its side ends with fastener systems for fastening to the non-rigid elements of the two free-standing posts. It is also possible to provide additional accessories in the sport game set, such as, for example, tennis rackets and balls, badminton rackets and shuttlecocks, volleyballs, footballs, means for delimiting the playing area, or other accessories.

In addition, the net is preferably provided with a width adjustment system, which offers the advantage of making it possible to adjust the width of the court or pitch and the spacing between the free-standing posts as a function of the available playing area or indeed as a function of the sport being played.

In a variant embodiment, the sport game set comprises at least one free-standing post, and at least one panel, which panel is provided on its back face with a fastener system for fastening to the non-rigid element of the free-standing post. For example, the panel may be constituted by a basketball basket, in which case a basketball is provided in the sport game set. It is also possible to provide two free-standing posts and two basketball basket panels in order to constitute a full basketball court.

In addition, such a panel may be a dartboard or an archery target, in which case the sport game set preferably further comprises additional accessories such as darts, a bow and arrows, or other accessories.

More comprehensive sport game sets may also be provided in view of the adaptability of the free-standing post of the invention.

BRIEF DESCRIPTION OF THE DRAWINGS

The following description makes it possible to understand the characteristics and advantages of the present invention, and is given with reference to the figures, in which.

MORE DETAILED DESCRIPTION

Figure 1:
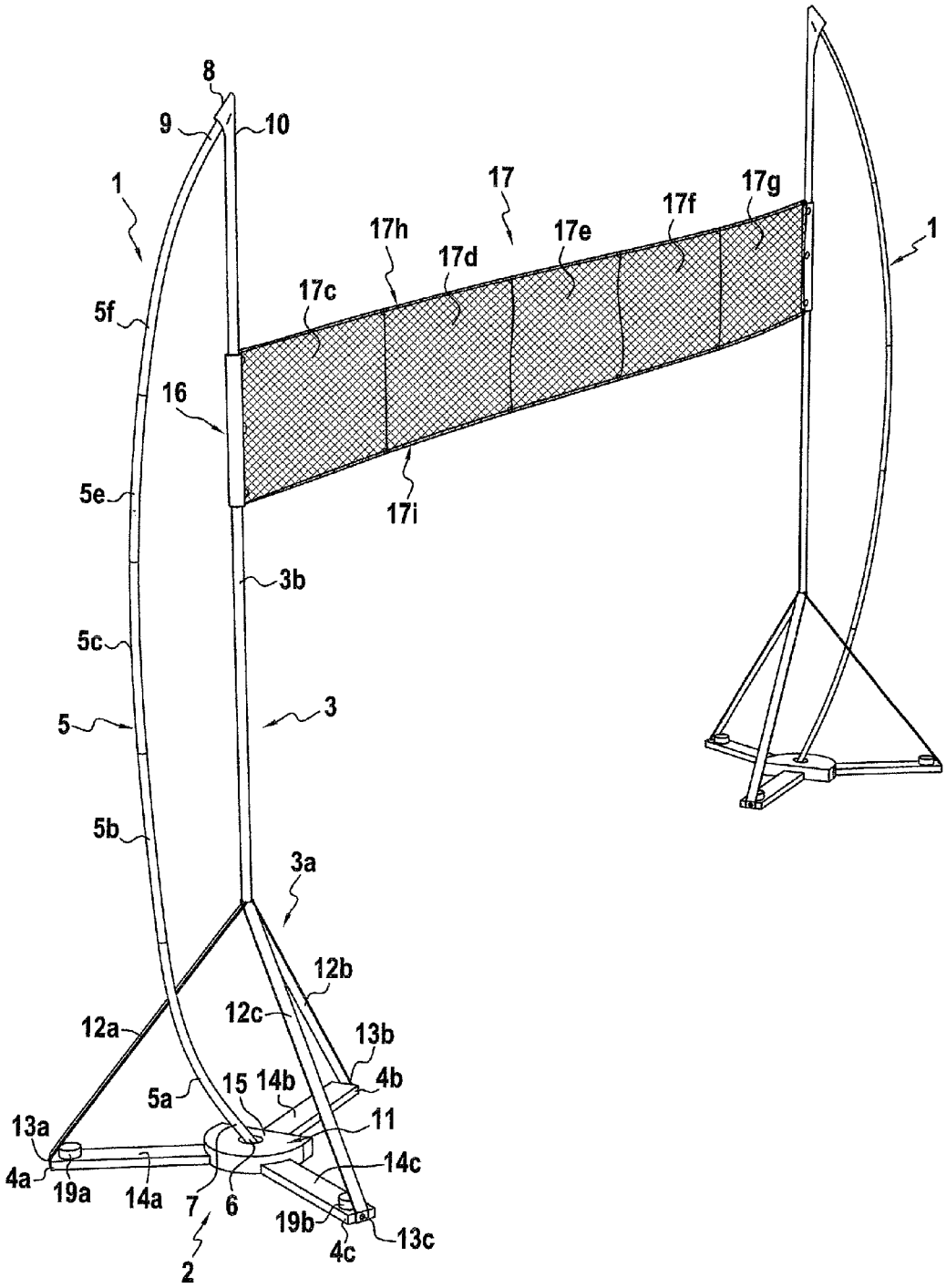
FIG. 1 shows a volleyball or badminton court having two free-standing posts between which a net extends transversely that is held at its ends to respective ones of said two free-standing posts of the invention.

FIG. 1 shows two free-standing posts 1 between which a net 17 extends transversely at some height.

Figure 3:
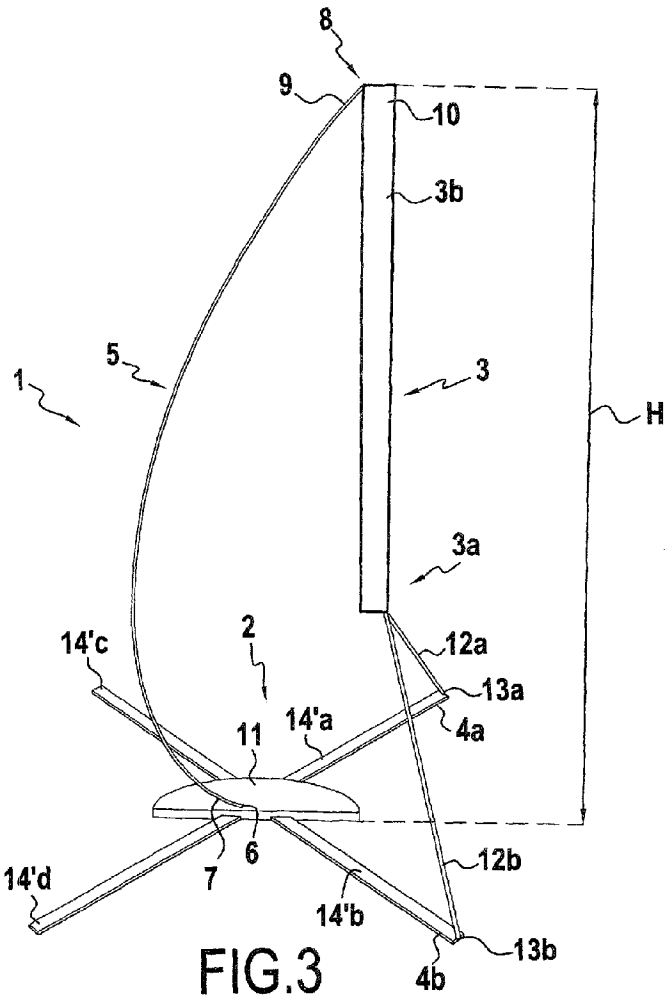
FIGS. 2 to 4 show three embodiments of the free-standing post of the invention.
Figure 2:
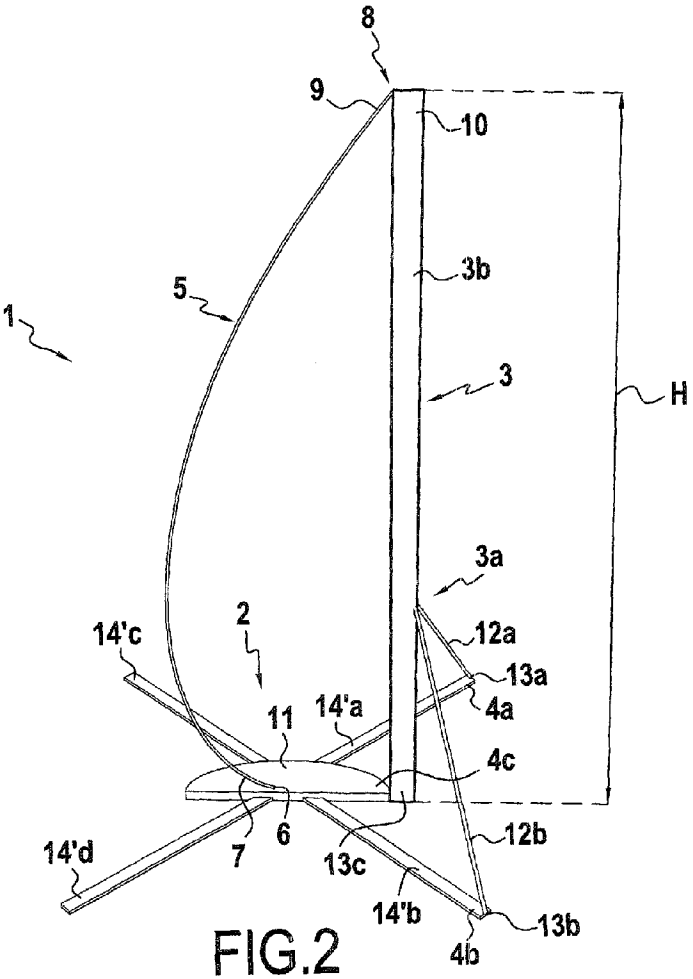
Figure 4:
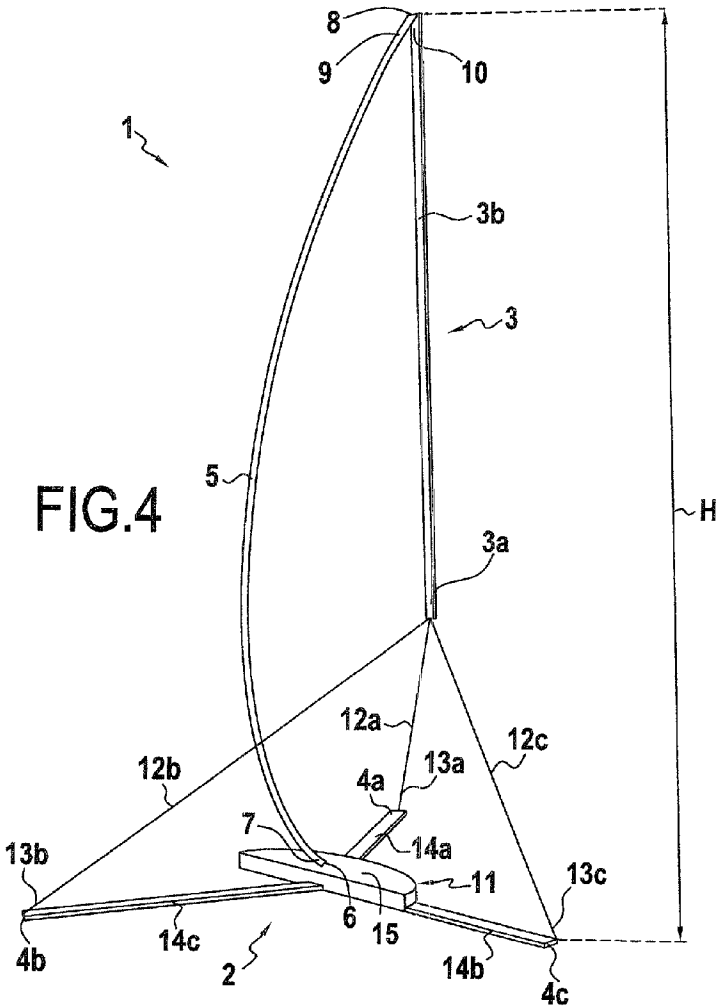

In various possible embodiments, such as the embodiments shown in FIGS. 2 to 4, the free-standing post 1 comprises a base 2 that stands on the ground, a non-rigid element 3 that extends vertically over a height H, and a flexible longitudinal element 5. It can be seen in the various FIGS. 1 to 5 and 8 that said flexible longitudinal element 5 has a bow shape having its bottom end 7 secured to the base 2 and its top end 9 secured to the top end 10 of the non-rigid element 3. In a rest position, said flexible longitudinal element 5 has a length greater than the height H, thereby enabling it to take up a bow shape and to hold the non-rigid element stretched out vertically over the height H. For this purpose, the non-rigid element has little or no elasticity.

It can be seen in FIGS. 1 to 5 that the non-rigid element 3 has a bottom portion 3*a* forming guys, this bottom portion 3*a* being extended by a longitudinal top portion 3*b*.

In FIG. 2, the non-rigid element 3 is constituted by a strap that makes it possible to form both the longitudinal top portion 3*b* and also a first guy 12*c* in the bottom portion 3*a* of said non-rigid element 3, which bottom portion also has two other guys 12*a*, 12*b*, the three guys 12*a*, 12*b*, 12*c* forming a tripod configuration. The guys 12*a*, 12*b* are also constituted by straps. However, it is possible to consider using ropes or the like. The straps are preferably made of a textile material.

In the second variant shown in FIG. 3, it can be seen that said non-rigid element 3 has a strap forming the longitudinal top portion 3*b*, while the bottom portion 3*a* comprises only two guys 12*a*, 12*b* forming an angle between them on either side of the strap.

In the third variant embodiment shown in FIG. 4, the bottom portion 3*a* of the non-rigid element 3 also has three guys 12*a*, 12*b*, 12*c*, disposed in a tripod configuration, one of the guys 12*c* being disposed extending the longitudinal top portion 3*b*, while the other two guys 12*a*, 12*b* are disposed symmetrically compared with the two guys shown in FIG. 2.

In the variants shown in FIGS. 3 and 4, said non-rigid element 3 is preferably made up of straps made of a textile material.

It can be seen in FIGS. 2 and 3 that the base 2 comprises a hub 11 and, preferably, four stabilizer legs 14'*a*, 14'*b*, 14'*c*, 14'*d*. Said hub 11 comprises a weight that makes it possible to weigh down the base 2. It is also possible to provide a hollow hub 11 provided with an orifice closed off by means of a stopper, enabling the hollow hub to be filled, e.g. with sand or with water. In addition, the hub 11 is preferably provided with recesses configured to receive the proximal ends of the stabilizer legs 14'*a*, 14'*b*, 14'*c*, 14'*d*. This offers the advantage of enabling the stabilizer legs to be fastened removably to the hub. Thus, it is possible to assemble the stabilizer legs and the hub so as to form the base, during assembly of the free-standing post, and also to disassemble the elements, while stowing away the free-standing post, in order to make it more compact.

Figure 5:
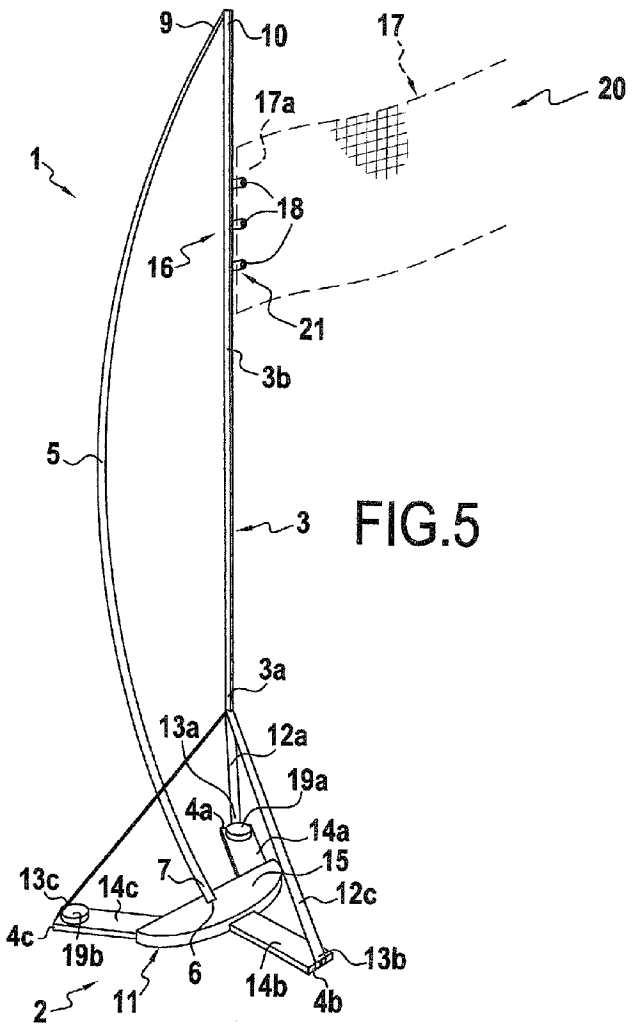
FIG. 5 shows a free-standing post to which a side end of a net is secured.

FIGS. 1, 4, and 5 show a variant embodiment of the stabilizer base 2. Said base is made up of three stabilizer legs 14*a*, 14*b*, 14*c* disposed in a star-shaped configuration. It can be seen that the three guys 12*a*, 12*b*, 12*c* are fastened at their bottom ends 13*a*, 13*b*, 13*c* to the distal ends of respective ones of the three stabilizer legs 14*a*, 14*b*, 14*c*. Preferably, provision is made for the proximal ends of the stabilizer legs 14*a*, 14*b*, 14*c* to be assembled together in pivotally mounted manner, thereby making it possible to fold the stabilizer legs away against one another when the free-standing post is in stowage mode, and thus to improve the compactness of said post. It can also be observed that small-size weights 19*a*, 19*b* are disposed in remote-from-center positions on the distal ends of the stabilizer legs, thereby making it possible to weigh down the stabilizer base 2 and thus to reinforce the stabilization of the free-standing post 1 by means of weights of small size.

In the various variant embodiments shown in FIGS. 1 to 5, the guys 12*a*, 12*b*, 12*c* have their bottom ends 13*a*, 13*b*, 13*c* fastened to the stabilizer base 2. This fastening may be permanent and implemented, for example, by adhesive bonding, stapling, or the like. However, it is possible to make provision for the guys to be fastened to the base removably, e.g. by using a male-and-female snap-fastening system arranged between the ends 13*a*, 13*b*, and 13*c* of the guys 12*a*, 12*b*, 12*c* and the distal ends of the stabilizer legs 14*a*, 14*b*, 14*c* or 14'*a*, 14'*b*, and optionally the hub 11.

The flexible longitudinal element 5 is preferably constituted by a flexible tube made up of a plurality of segments or pole pieces 5*a*, 5*b*, 5*c*, 5*e*, 5*f* as shown in FIG. 1, these pole pieces fitting together by mutual engagement and being disengageable so as to fold away the flexible tube. This offers the advantage of improving the compactness of the free-standing post in its stowage mode. Naturally, it is possible to provide flexible longitudinal elements in the form of flexible slats or in the form of any other variant.

The bottom end 7 of the flexible longitudinal element 5 is engaged into the hub 2. For this purpose, in the embodiment shown in FIGS. 2 and 3, the hub 11 is provided with an orifice 6 configured to receive the bottom end 7 of the flexible longitudinal element 5 by mutual engagement. Preferably, said orifice 6 extends in outwardly sloping manner, thereby making it possible, when the bottom end 7 of the flexible longitudinal element 5 is engaged, to keep said bottom end extending outwards with the bow being formed. The same applies in the embodiment shown in FIGS. 1, 4, and 5, an orifice 6 being provided in the centre of the stabilizer base 2.

Anchor means 8 are provided between the top end 9 of the flexible longitudinal element 5 and the top end 10 of the top portion 3*b* of the non-rigid element 3. Said anchor means 8 are, for example, constituted by a male-and-female snap-fastening system arranged at said top ends 9, 10, thereby fastening said elements together removably.

It can be observed in FIGS. 1, 5, 6 and 7, that a fastener system 16 is arranged between the article 17 and the longitudinal top portion 3*b* of the non-rigid element 3. The fastener system 16 is, for example, constituted by a male-and-female snap-fastening system. However, other variants are possible, such as a system of loops and of hooks.

Figure 7:
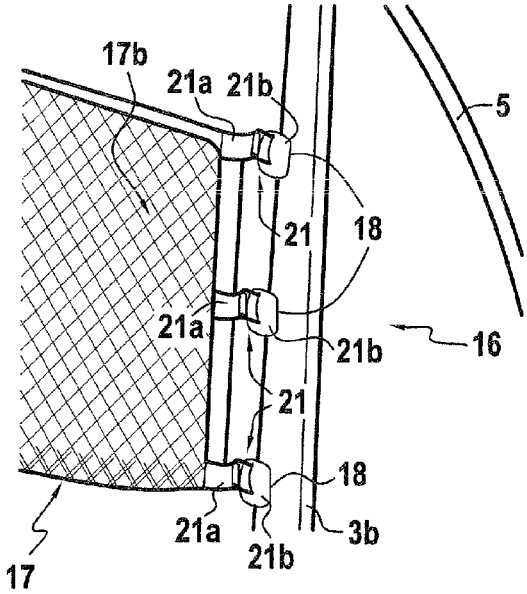

In FIGS. 5 and 7, it can be observed that each of the side ends 17*a*, 17*b* of the net 17 is provided with three male pieces 21*a*. In addition, three female pieces 21*b* are fastened to the longitudinal top portion 3*b* of the longitudinal element 3, the male portions 21*a* snap-fastening in the female portions 21*b*. It is also possible to provide a certain number of additional female pieces 21*b* on the non-rigid element 3 that are preferably distributed uniformly so as to enable the net 17 to be fastened at various heights. It is also possible to make provision for the heights of the female pieces 21*b* to be adjustable over the longitudinal top portion 3*b* of the non-rigid element 3, e.g. by means of them being slidably mounted or by means of the female pieces 21*b* being clamped onto the top portion 3*b* of the non-rigid element 3, which is, in particular, constituted by a strap.

Figure 6:
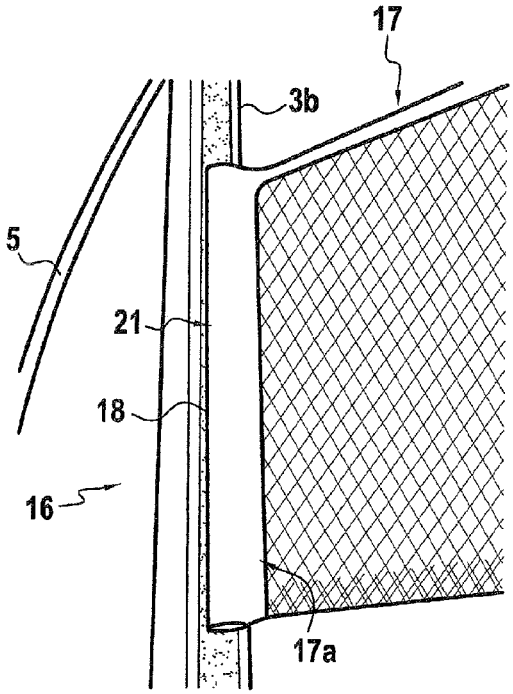
FIGS. 6 and 7 shows two variants for the fastening between an article of the net type and a free-standing post of the invention.

In the variant shown in FIG. 6, the side end 17*a* of the net 17 is provided with loops or with hooks, the longitudinal top portion 3*b* of the non-rigid element 3 in the form of a strap also being provided with hooks or with loops, enabling it to be fastened to said side end 17*a* of the net 17. Naturally, this design is also provided for the other side end of the net 17. In addition, implementing hooks or loops over the entire length of the longitudinal top portion 3*b* makes it possible to adjust the height of the net relative to the free-standing post, at the user's convenience.

In addition, in these various embodiments in which means are provided for adjusting the height of the fastener system on the non-rigid element, measurement is preferably indicated by means of a graduated rule arranged, in particular along the longitudinal top portion 3*b* of the non-rigid element 3.

It can be observed in FIGS. 1 and 5 that the net 17 is made up of a plurality of longitudinal portions 17*c*, 17*d*, 17*e*, 17*f*, 17*g* mounted to slide relative to one another. For example, it is possible to provide slidable mounting at the top edges 17*h* and at the bottom edge 17*i* of said longitudinal portions of the net 17. This offers the advantage of setting the length of the net 17 and thus the spacing between the two free-standing posts 1 as shown in FIG. 1.

The two free-standing posts 1 and the net 17 that are shown in FIG. 1 constitute a sport game set to which it is possible to add additional accessories such as rackets and balls or shuttlecocks, volleyballs, footballs, or indeed other accessories related to these types of activity, in particular means for delimiting the playing area, such as ropes, straps, or the like.

Figure 8:
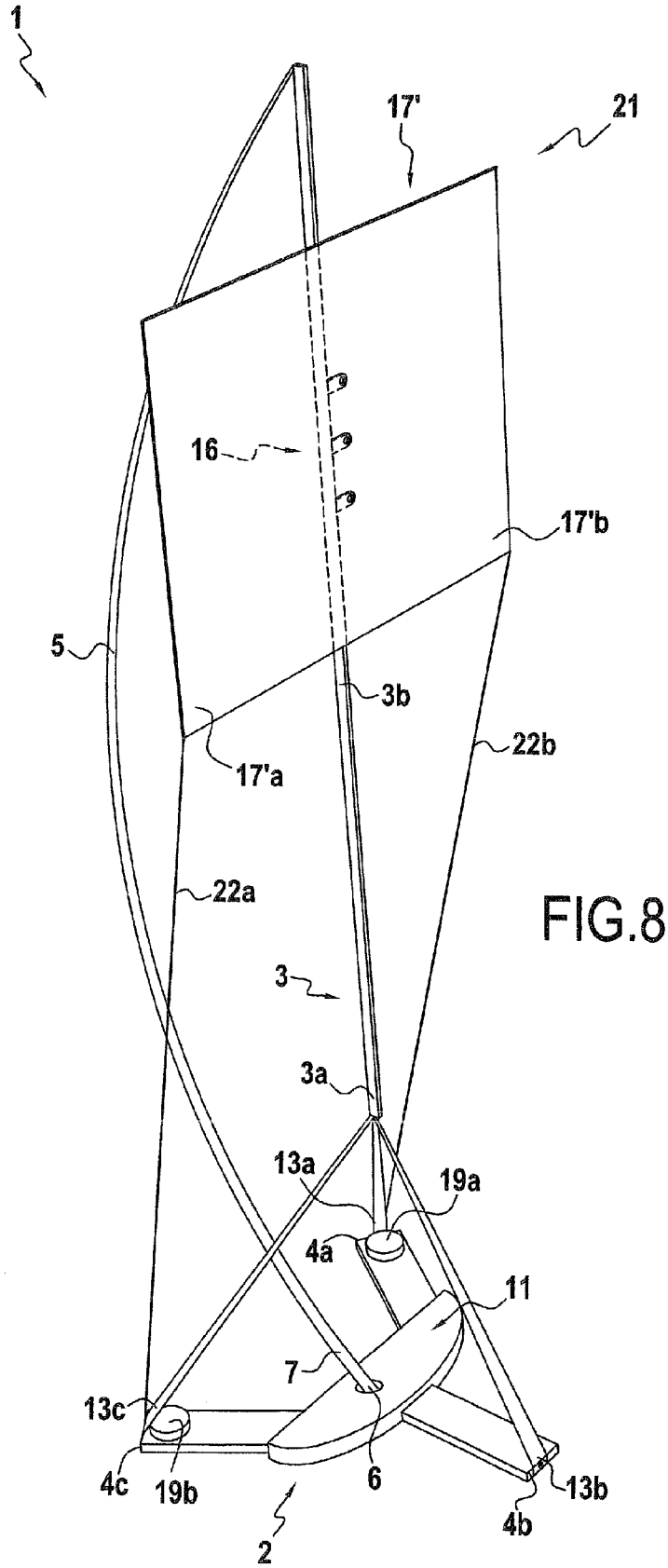
FIG. 8 shows an article of the panel type that is fastened to a free-standing post of the invention.

However, such a free-standing post may make it possible to constitute other sport game sets. As shown in FIG. 8, the free-standing post 1 makes it possible to support an article of the panel type 17' that is preferably made of a lightweight material. This panel 17' may consist of a basketball basket or of an archery target or dartboard. A fastener system 16' is arranged between the back face of the panel 17' and the top portion 3*b* of the non-rigid element 3, it being possible for said fastener system 16' to be identical to the fastener systems described above for when the article is a net 17. In addition, straps 22*a*, 22*b* such as the straps shown in FIG. 8 are preferably provided to constitute guys arranged between the bottom corners 17'*a*, 17'*b* of the panel 17' and the stabilizer base 2, as shown, for example, in FIG. 8. This makes it possible to stabilize the panel 17' on the free-standing post 1. Such a sport game set 21 may include additional accessories. When the panel 17' is a basketball basket, a basketball is, in particular, provided. The sport game set may also be constituted by two freestanding posts 1 and by two basketball baskets 17'. When such a panel 17' is a dartboard or an archery target, the sport game set 21 includes additional accessories of the darts type, or of the bow-and-arrows type.

Figure 9:
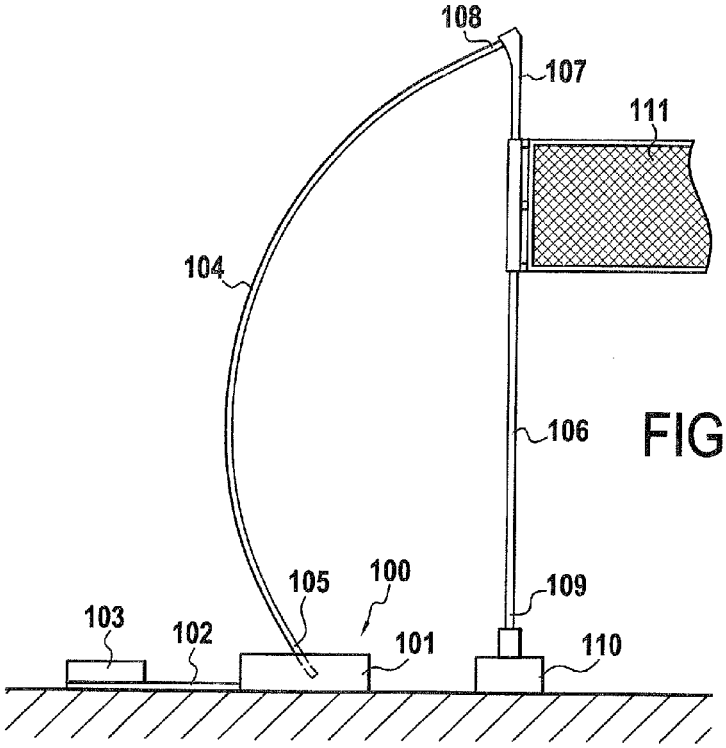
FIGS. 9 to 12 show two variant embodiments of a free-standing post of the present invention.

Numerous variants of the free-standing post are possible without going beyond the ambit of the invention. FIGS. 9 to 12 show some of them. In FIG. 9, it can be observed that the stabilizer means are made up of a base 100 provided with a hub 101 into which a stabilizer leg 102 is engaged that extends outwards from the free-standing post, a small-size weight 103 being mounted removably on the distal end of said stabilizer leg 102. The flexible element has its bottom end 105 engaged in the hub 101 such that said bottom end extends outwards from the free-standing post. In addition, the non-rigid element 106 consists of a single strap or the like, having its top end 107 fastened removably or otherwise to the top end 108 of the flexible element, while the bottom end 109 of the non-rigid element 106 is fastened, e.g. by means of a ring, to a complementary weight 110 that constitutes an element of said stabilizer means. The net 111 is fastened to said non-rigid element 106.

Figure 10:
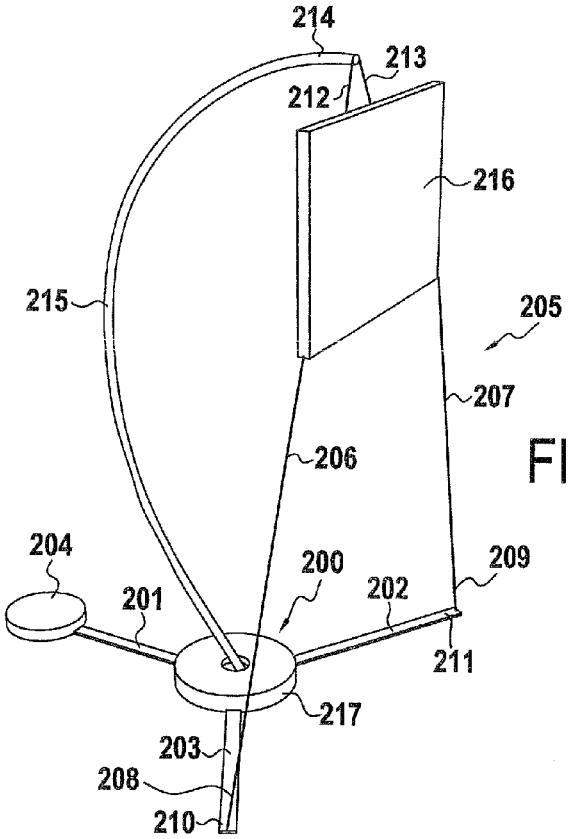

In the example shown in FIG. 10, the stabilizer base 200 comprises a hub 217 into which three stabilizer legs 201, 202, 203 are engaged removably, one of which legs (201) extends outwards from the free-standing post and supports a remote-from-center small-size weight 204 at its distal end, while the other two legs 202, 203 extend inwards from the free-standing post while forming an angle between them.

It can be observed that the non-rigid element 205 is made up of two straps 206, 207 or the like having their bottom ends 208, 209 fastened to respective ones of the distal ends 210, 211 of the two inner stabilizer legs 202, 203, while the top ends 212, 213 of the straps 206, 207 meet and are fastened to the top end 214 of the flexible element 215. In the example shown in FIG. 10, a panel 216, in particular a dartboard, is supported jointly by the two straps 206, 207.

Figure 11:
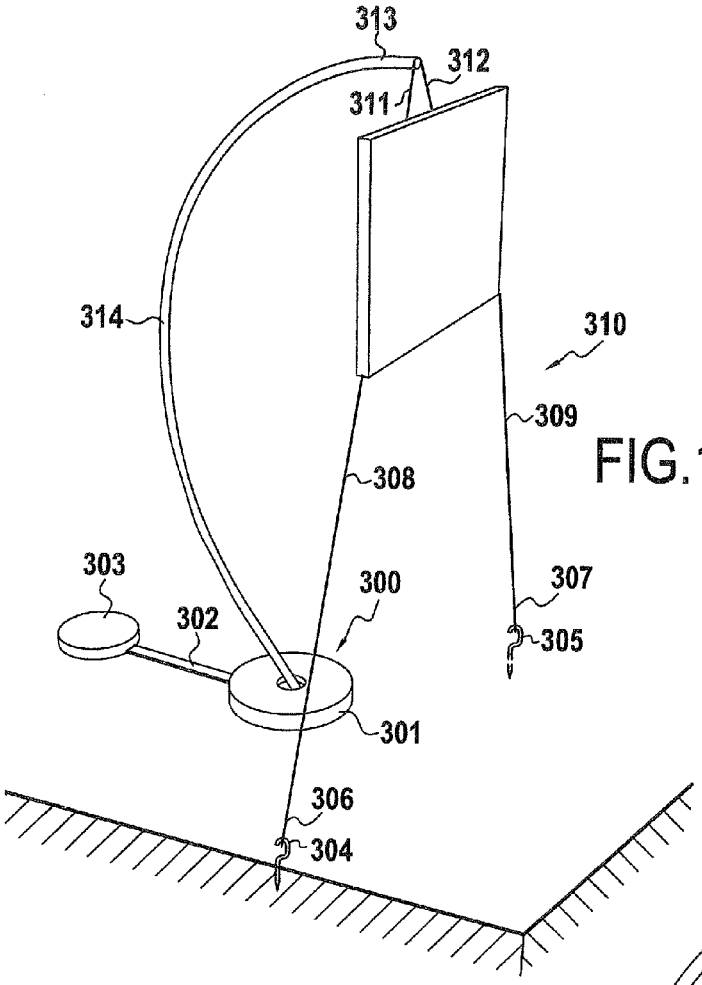

In the example shown in FIG. 11 that is similar to the example shown in FIG. 10, the stabilizer means are made up of a stabilizer base 300 provided with a hub 301 and with a stabilizer leg 302 extending outwards from the free-standing post and supporting a removable small-size weight 303 at its distal end. In addition, these stabilizer means also include two pegs or stakes 304, 305 driven into the ground and fastened to respective ones of the bottom ends 306, 307 of two straps 308, 309 constituting the non-rigid element 310, the top ends 311, 312 meet and are fastened to the top end 313 of the flexible element 314.

Figure 12:
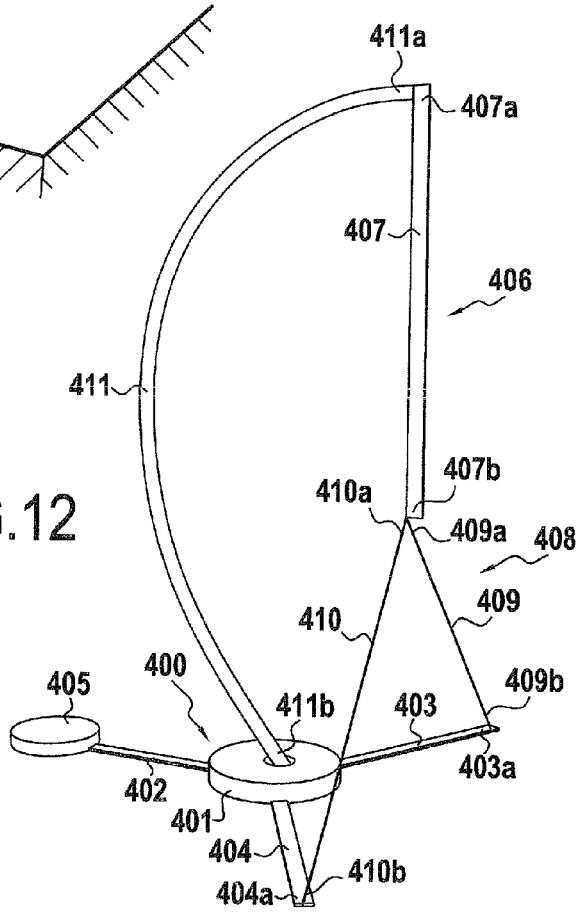

In the example shown in FIG. 12 that is similar to the example shown in FIG. 10, a stabilizer base 400 is also provided that comprises a hub 401 into which three stabilizer legs 402, 403, 404 are engaged removably. The first stabilizer leg 402 extends outwards from the free-standing post and receives a small-size weight 405 at its distal end. The other two stabilizer legs 403, 404 extend inwards from the free-standing post while forming an angle between them.

In addition, the non-rigid element 406 comprises a longitudinal top portion 407, in particular constituted by a strap, and a bottom portion 408 made up of two guys 409, 410, in particular constituted by straps. The top ends 409*a*, 410*a* of the two guys 409, 410 meet and are fastened to the bottom end 407*b* of the longitudinal top portion 407, while their bottom ends 409*b*, 410*b* diverge and are fastened to respective ones of the distal ends 403*a*, 404*a* of the two stabilizer legs 403, 404. In addition, the top end 407*a* of the longitudinal top portion 407 is fastened to the top end 411*a* of the flexible element 411, which has its bottom end 411*b* assembled to the hub 401.

Combinations of the various examples shown in FIGS. 1 to 12 and described above are possible without going beyond the ambit of the invention.

Other characteristics may also be considered without going beyond the ambit of the present invention, in particular as regards the number of guys on the bottom portion 3*a* of the non-rigid element 3, as regards the anchor means for anchoring between the stabilizer base 2, the non-rigid element 3, and the flexible longitudinal element 5, as regards the fastener system 21 for fastening the article 17, 17' to the non-rigid element 3, as regards the design of the stabilizer base 2, or indeed as regards other features.

What is claimed is:

1. A free-standing post comprising stabilizer means for stabilizing it on the ground, wherein said free-standing post further comprises:

a non-rigid element for holding an article, which element extends upwards over a height H and has a bottom portion extended by a top portion, first anchor means being arranged between the stabilizer means and the bottom portion; and a flexible longitudinal element of length greater than the height H of the non-rigid element, second anchor means being arranged between the bottom end of the flexible longitudinal element and the stabilizer means, and third anchor means being arranged between the top end of said flexible longitudinal element and the top end of the top portion of said non-rigid element.

2. A free-standing post according to claim 1, the non-rigid element being made of a textile material.

3. A free-standing post according to claim 1, the stabilizer means being provided with at least two first fastener systems, the bottom portion of the non-rigid element being constituted by at least two guys that extend downwards while forming an angle between them, the bottom ends of the guys being provided with second fastener systems co-operating with respective ones of the first fastener systems.

4. A free-standing post according to claim 3, the stabilizer means consisting of a stabilizer base provided with three first fastener systems that are distributed triangularly, the bottom portion of the non-rigid element being made up of three guys disposed in a tripod configuration, the bottom ends of the guys being provided with second fastener systems co-operating with respective ones of the first fastener systems.

5. A free-standing post according to claim 4, one of the three guys extending downwards from the longitudinal top portion.

6. A free-standing post according to claim 1, the stabilizer means consisting of a stabilizer base comprising three stabilizer legs disposed in a star-shaped configuration.

7. A free-standing post according to claim 6, the proximal first ends of the three stabilizer legs being assembled together in pivotally mounted manner so as to enable them to be folded away against one another, so as to improve the compactness of the stabilizer means in a stowage mode.

8. A free-standing post according to claim 1, the stabilizer means consisting of a stabilizer base comprising a hub and at least two stabilizer legs.

9. A free-standing post according to claim 8, the stabilizer legs being designed to be engaged into the hub, so as to enable them to be removed from the hub so as to group them together for compact stowage.

10. A free-standing post according to claim 1, the flexible longitudinal element being constituted by a flexible tube.

11. A free-standing post according to claim 10, the flexible tube comprising at least two segments that are suitable for being mutually engaged and for being folded up together.

12. A free-standing post according to claim 10, the flexible tube being telescopic.

13. A free-standing post according to claim 1, the stabilizer means consisting of a stabilizer base provided with an orifice for receiving the bottom end of the flexible longitudinal element.

14. A free-standing post according to claim 13, the orifice being configured to incline the bottom end of the flexible longitudinal element engaged in said orifice.

15. A free-standing post according to claim 1, the top portion of the non-rigid element being constituted by a strap.

16. A free-standing post according to claim 1, a fastener system being arranged on the non-rigid element for securing to an article.

17. A free-standing post according to claim 16, height adjustment means being arranged between the fastener system and the non-rigid element.

18. A free-standing post according to claim 17, a system for indicating the height position of the fastener system being arranged on the non-rigid element.

19. A free-standing post according to claim 1, the stabilizer means further comprising weighing-down means.

20. A free-standing post according to claim 19, the stabilizer means consisting in a stabilizer base comprising at least one stabilizer leg on which weighing-down means are disposed in remote-from-center manner.

21. A sport game set comprising two free-standing posts according to claim 1, and a net provided at its side ends with fastener systems for fastening to the non-rigid elements of the two free-standing posts.

22. A sport game set according to claim 21, which set further comprises at least one additional accessory chosen from tennis rackets and balls, badminton rackets and shuttlecocks, volleyballs, footballs, or means for delimiting the playing area.

23. A sport game set according to claim 21, the net being provided with a width adjustment system.

24. A sport game set comprising at least one free-standing post according to claim 1, and at least one panel, said at least one panel being provided on its back face with a fastener system for fastening to the non-rigid element of said at least one free-standing post.

25. A sport game set according to claim 24, further comprising a stabilizer system for stabilizing the panel in its fastened position in which it is fastened to the free-standing post.

26. A sport game set according to claim 24, the panel being a basketball basket, said sport game set further comprising a basketball.

27. A sport game set according to claim 24, the panel being a dartboard or an archery target, said set further comprising additional accessories chosen from darts, and a bow and arrows.

* * * * *